US009535404B2

(12) United States Patent
Bas et al.

(10) Patent No.: US 9,535,404 B2
(45) Date of Patent: Jan. 3, 2017

(54) METHOD FOR ADAPTING A TIMEPIECE MOVEMENT PROVIDED TO OPERATE IN AMBIENT ATMOSPHERIC PRESSURE SO AS TO OPERATE IN A LOW-PRESSURE ATMOSPHERE

(71) Applicant: CARTIER CREATION STUDIO S.A., Genève (CH)

(72) Inventors: Kewin Bas, Villers-le-Lac (FR); Cyrille Chatel, La Chenalotte (FR)

(73) Assignee: CARTIER INTERNATIONAL AG, Steinhausen (CH)

( * ) Notice: Subject to any disclaimer, the term of this patent is extended or adjusted under 35 U.S.C. 154(b) by 0 days.

(21) Appl. No.: 14/363,836

(22) PCT Filed: Dec. 4, 2012

(86) PCT No.: PCT/IB2012/002576

§ 371 (c)(1),
(2) Date: Jun. 9, 2014

(87) PCT Pub. No.: WO2013/084043

PCT Pub. Date: Jun. 13, 2013

(65) Prior Publication Data

US 2014/0341002 A1 Nov. 20, 2014

(30) Foreign Application Priority Data

Dec. 9, 2011 (EP) ..... 11009705

(51) Int. Cl.

| | |
|---|---|
| ***G04B 17/20*** | (2006.01) |
| ***G04B 18/00*** | (2006.01) |
| ***G04B 9/00*** | (2006.01) |
| ***G04B 37/02*** | (2006.01) |
| ***G04B 1/22*** | (2006.01) |

(52) U.S. Cl.

CPC ..... *G04B 37/02* (2013.01); *G04B 1/22* (2013.01); *G04B 1/225* (2013.01); *G04B 17/20* (2013.01)

(58) Field of Classification Search

CPC ..... G04B 1/22; G04B 1/225; G04B 17/20; G04B 17/24; G04B 37/02

USPC ..... 368/170, 171, 200, 202, 210

See application file for complete search history.

(56) References Cited

U.S. PATENT DOCUMENTS

| | | | | |
|---|---|---|---|---|
| 3,616,638 | A * | 11/1971 | Bennett et al. | 368/159 |
| 3,630,014 | A * | 12/1971 | Jeannet et al. | 368/184 |
| 3,759,028 | A * | 9/1973 | Tsuruishi | 368/158 |
| 9,389,588 | B2 * | 7/2016 | Bas | G04B 37/02 |
| 9,423,771 | B2 * | 8/2016 | Bas | G04D 7/007 |
| 2006/0114750 | A1 * | 6/2006 | Iida et al. | 368/67 |
| 2007/0133355 | A1 * | 6/2007 | Hara et al. | 368/140 |
| 2007/0283586 | A1 * | 12/2007 | Hillis | 368/179 |
| 2009/0086584 | A1 * | 4/2009 | Takahashi et al. | 368/148 |
| 2013/0064047 | A1 * | 3/2013 | Kaelin et al. | 368/220 |

FOREIGN PATENT DOCUMENTS

| | | | |
|---|---|---|---|
| EP | 1 973 013 | A1 | 9/2008 |
| FR | 1 546 744 | A | 11/1968 |
| FR | 2 054 540 | A1 | 4/1971 |
| GB | 1 272 183 | A | 4/1972 |

OTHER PUBLICATIONS

HyperPhysics, Jun. 30, 2004, Georgia State University, attached pp. 1-5, <hyperphysics.phy-astr.gsu.edu/hbase/hph.html>.*

"Percentage Change", Feb. 28, 2011, Mathisfun.com, full document, Retrieved on Sep. 3, 2015 from <https://web.archive.org/web/20110228052527/http://www.mathsisfun.com/numbers/percentage-change.html>.*

International Search Report, dated May 6, 2013, from corresponding PCT application.

* cited by examiner

*Primary Examiner* — Amy Cohen Johnson
*Assistant Examiner* — Daniel Wicklund
(74) *Attorney, Agent, or Firm* — Young & Thompson

(57) ABSTRACT

A method for adapting a timepiece movement includes measuring a loss of energy for each free oscillation of the balance at atmospheric pressure; measuring the loss of energy for each free oscillation at a given low pressure corresponding to a working pressure intended for a modified movement; using i) the measured loss of energy at atmospheric pressure and ii) the measured loss of energy at the given low pressure, determining a percentage of energy gain of the balance between respective i) measurements of the measured loss of energy at atmospheric pressure and ii) measurements of the measured loss of energy at the given low pressure; and reducing a torque delivered to the escapement by a value corresponding to the determined percentage of energy gain.

8 Claims, 2 Drawing Sheets

METHOD FOR ADAPTING A TIMEPIECE MOVEMENT PROVIDED TO OPERATE IN AMBIENT ATMOSPHERIC PRESSURE SO AS TO OPERATE IN A LOW-PRESSURE ATMOSPHERE

BACKGROUND OF THE INVENTION

Description of the Related Art

Documents FR1546744, FR2054540 and GB1272183 explain that in a watch under reduced pressure, the quality of these watches over time is improved, in particular since the risks of oxidisation of the movement and of the oils are reduced and since aging of the lubricants and wear due to oxidisation and corrosion are reduced.

Moreover, as indicated in document FR2054540, by reducing the pressure prevailing within a watch case, the loss of energy owing to air friction tends towards zero and hence the quality factor of the oscillator of the timepiece movement increases considerably. Herein, "vacuum" or "protective atmosphere" or "low-pressure atmosphere" is understood to mean a pressure which is generally lower than atmospheric pressure, with or without an added gas, which is maintained within a case which has been optimised to preserve this low pressure.

A movement in accordance with FR2054540 is designed in terms of the high vacuum in which its oscillator operates, and it is incapable of operating correctly in normal atmospheric pressure owing to the large difference between atmospheric pressure and its intended operating pressure which is of the order of 1/10 to 1/100000 mmHg. Consequently, the movement of this watch is entirely designed in terms of the high vacuum in which its oscillator operates. However, the design of a movement in a protective and controlled low-pressure atmosphere is a complex task which is not very convenient or effective, and document FR2054540 provides no indication how this can be achieved.

BRIEF SUMMARY OF THE INVENTION

The aim of the present invention is a method for adapting (or re-dimensioning and/or re-designing to a certain degree) a mechanical timepiece movement intended to operate at ambient atmospheric pressure so as to operate in a low-pressure protective atmosphere between 0.1 mbar and 200 mbar, in a practical, effective, calculated and optimum manner.

DETAILED DESCRIPTION OF THE PREFERRED EMBODIMENTS

The invention preferably relates to a purely mechanical timepiece movement comprising at least one barrel, a regulating member in the form of a balance-spring, an escapement maintaining the oscillations of the balance-spring, and a finishing going train transmitting the drive force of the barrel to the escapement. The invention relates more particularly to a line of movements of the same calibre comprising equivalent components. The invention relates in particular to the adaptation of a movement originally designed to operate in atmospheric pressure.

The method in accordance with the invention comprises the following steps.

1. measuring the quality factor of the movement at atmospheric pressure, 2. measuring the quality factor of the movement at a predetermined low pressure corresponding to the operating pressure provided for the movement, typically at a pressure between 0.1 and 200 mbar,
3. calculating the energy gain between the two measurements,
4. adapting the dimensions of the movement based on this energy gain, in particular by modifying at least one of the following elements of the movement: the reduction ratio of the finishing going train, the torque of the barrel, the size of the barrel and the inertia of the balance.

Preferably, the quality factor is measured at a plurality of low pressures so as to obtain an evolution thereof as a function of pressure, and thereafter the low operating pressure which provides a particular energy gain is selected.

BRIEF DESCRIPTION OF THE DRAWINGS

The method will now be disclosed in greater details with reference to the accompanying drawings in which.

The first step in the method for adapting a conventional timepiece movement operating at ambient atmospheric pressure for its operation in a low-pressure atmosphere consists of measuring the quality factor of the mechanical timepiece movement operating at atmospheric pressure by a conventional process. Preferably, the quality factor is measured directly, but alternatively it can be measured indirectly, for example by measuring the amplitude of the balance and calculating therefrom the quality factor.

The second step of the method consists of placing the mechanical timepiece movement in a predetermined low-pressure atmosphere, typically between 0.1 and 200 mbar corresponding to the operating pressure of the movement, then measuring the quality factor thereof. In this step, it is more difficult to measure the quality factor directly and it may thus be preferable to measure it indirectly, at least in part.

In order to measure the quality factor indirectly, the entire movement can be placed in the vacuum and the amplitude gain of the balance of the movement can be measured, acoustically or visually, as a function of the pressure. This process has the advantage of being rapid since the pressure can be decreased step-by-step and a measurement can be taken at each step. It has the disadvantage of not resulting directly in the value of the quality factor (this is deduced therefrom by calculation) which will then be used to dimension and adapt the movement.

Figure 1:
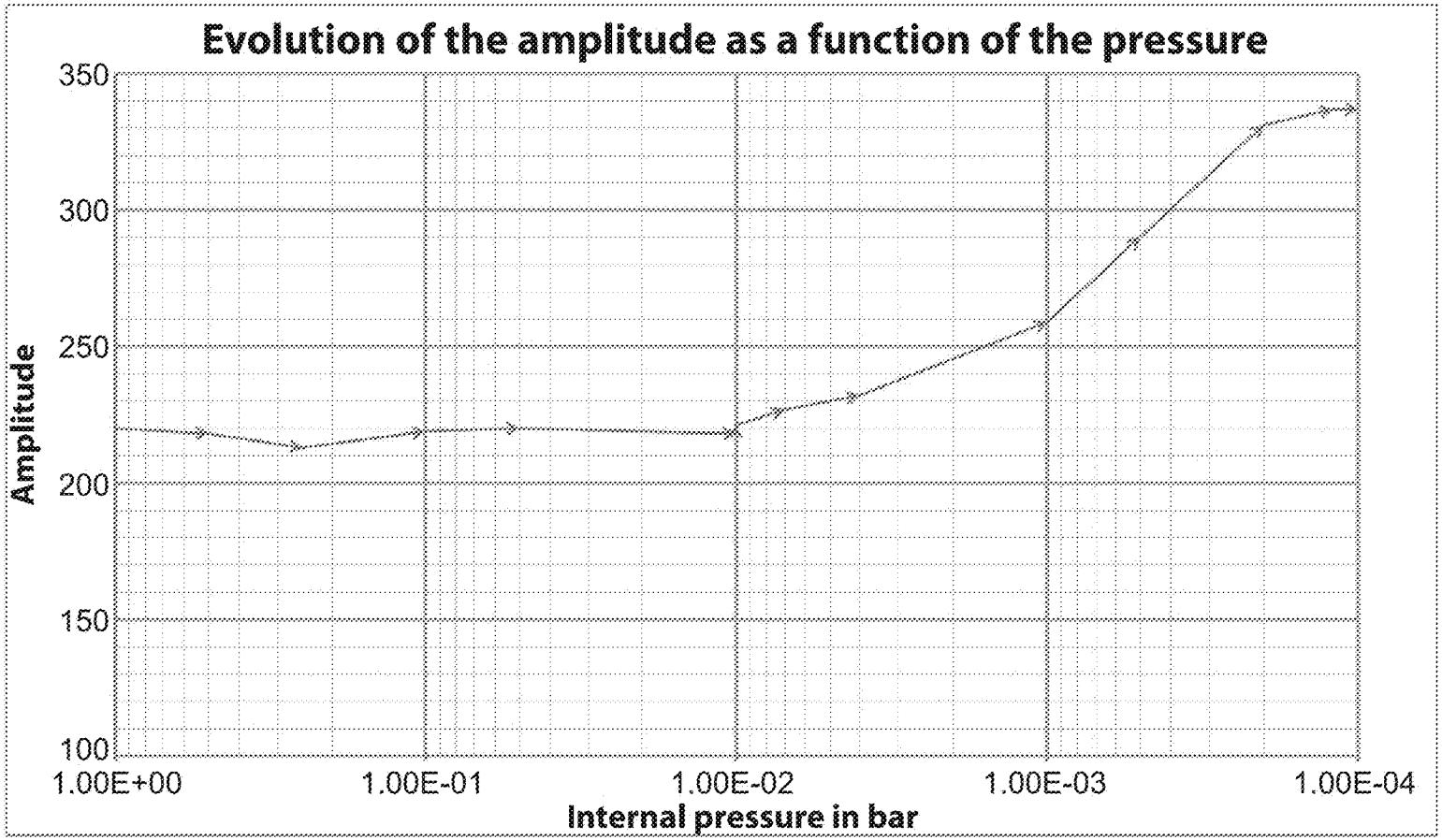
FIG. 1 is a graph showing an example of measuring the evolution of the amplitude of the balance as a function of the internal pressure of the watch.

The graph of FIG. 1 shows an example of measuring the evolution of the amplitude of the balance as a function of the internal pressure of the watch.

In order to carry out this measurement, the movement can also be placed into the vacuum without the amplitude maintaining system (the pallets are removed from the escapement) and the amplitude loss of the balance as a function of time can be measured visually.

This direct measurement is more complicated to implement for several reasons:

It is necessary to impart an impulse to "launch" the balance with a large amplitude (greater than 350°).

This operation may be relatively simple out in the open but it becomes more complicated when the movement is in a vacuum casing.

In accordance with the technical solution which has been chosen, which is not the only one possible, the balance is pre-cocked at an angle of, for example, 350° and it is locked in this position. The movement is then placed under vacuum at the desired pressure, the balance is released and the evolution of the amplitude of the balance as a function of time is measured visually. The balance stop system (in the setting position) can be used to lock the balance at 350°, if the movement being tested is provided with such a system. In order to release the balance for measuring purposes, the stem just needs to be pushed back.

For each measurement, it is necessary to return to atmospheric pressure to re-cock the balance.

This measurement is more precise but more tedious to accomplish. It is preferable to firstly take the first measurement to "target" the seconds.

Figure 2:
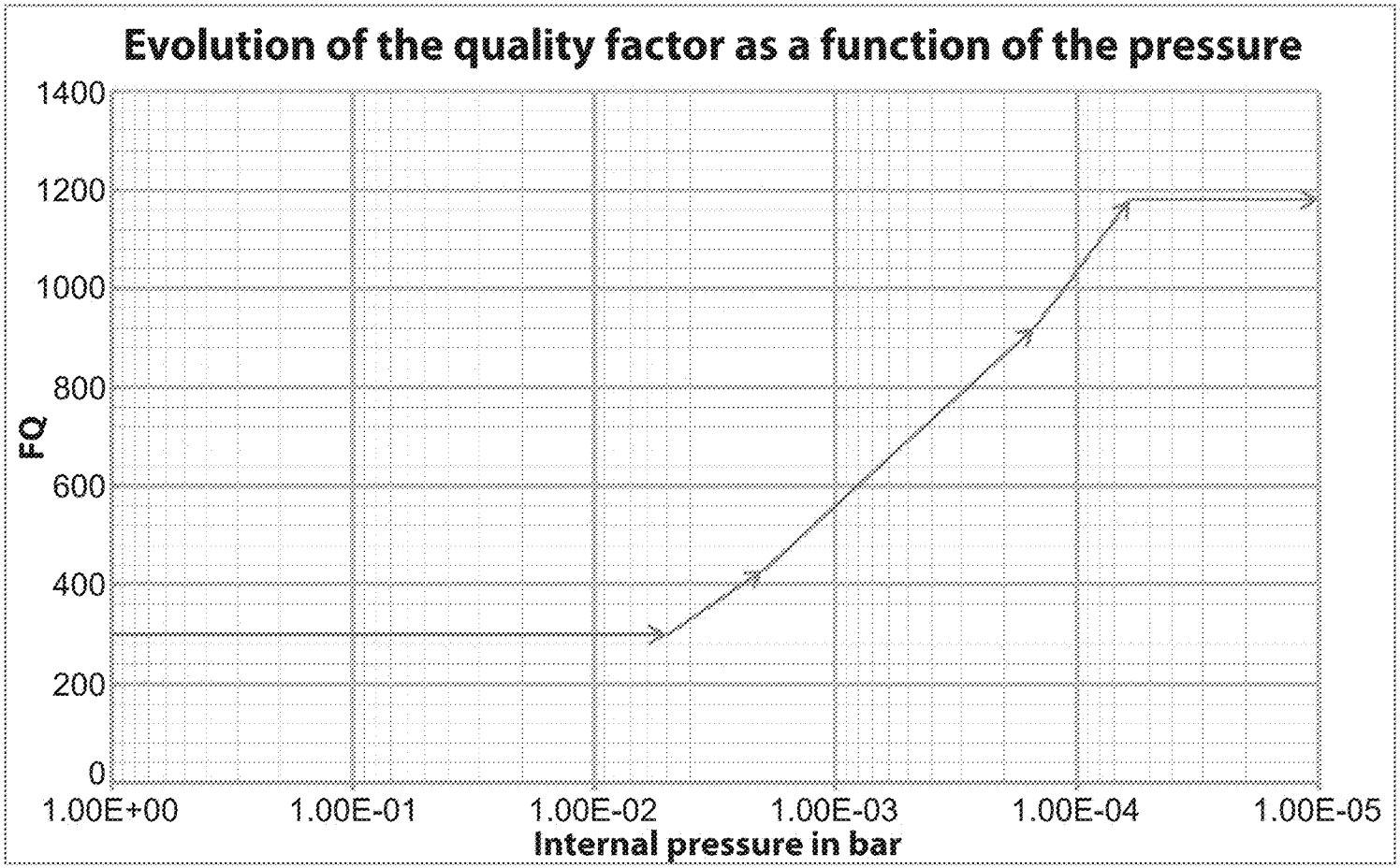
FIG. 2 is a graph showing an example for measuring the quality factor (at a balance amplitude of 280°) as a function of the pressure.

The graph illustrated at FIG. 2 shows an example for measuring the quality factor (at a balance amplitude of 280°) as a function of the pressure in accordance with this example.

It can be seen from these measurements that the range of pressure of interest for the energy performance gain of the movement is located especially between 5 mbar and 0.1 mbar, and in any case preferably below 200 mbar.

Preferably, the operating pressure of the movement remains in the range of 5 mbar and 0.1 mbar even if the quality factor increases for lower pressures. In fact, a decrease below a pressure of 0.1 mbar will cause other problems, such as degassing of the oils (in the case of a lubricated movement), keeping the seal over a long period of time being extremely complex (or even impossible if not maintained), critical increase of the hanging plate (the dry friction losses of the balance prevail and thus the amplitude difference between the horizontal and vertical positions increases).

The third step of the method for adapting the movement consists of calculating the gain in the quality factor between operation of the movement in atmospheric pressure and operation in predetermined reduced pressure.

The quality factor is given by the formula:

$$\Delta E = \frac{2 \times \pi \times E}{QF}$$

or, if $E=2\times n^2\times f^2\times I_{bal}\times\theta^2$, for example $$QF = \frac{4 \times \pi^3 \times f^2 \times I_{bal} \times \theta^2}{\Delta E}$$

where:

QF: quality factor f: frequency of the balance $I_{bal}$: inertia of the balance θ: amplitude of the balance ΔE: energy lost by oscillation of the balance.

In one alternative, it could be considered that $$E=\tfrac{1}{2}\times K \text{ balance spring}\times\theta^2$$

where K=spring rate of the balance spring.

In accordance with this example, if, for a given movement, the quality factor at atmospheric pressure is 300, it can increase to 450 when operating at reduced pressure. The energy loss per oscillation of the balance decreases from 100 microJ to 70 microJ, which represents a gain of 30% for an operating amplitude of the balance of 280°, a frequency of 4 Hz and an inertia of the balance of 0.63 g·mm$^2$.

The fourth step of the method consists of adapting the dimensions of the movement as a function of the energy gain obtained in particular by modifying one or more of the following elements of the movement:

reduction ratio of finishing going train, torque of the barrel, size of the barrel, inertia of the balance.

This adaptation of the dimensions of the movement is effected based on the performances or qualities of the movement that are desirably favoured such as for example:

increase in the power reserve, decrease in the size, increase in the precision of the watch.

For example, once the energy gain has been quantified, the finishing going train can be resized so as to increase the power reserve.

In accordance with this example, the energy necessary to maintain the balance at an amplitude of 280° decreases from 100 microJ to 70 microJ. Therefore, the torque transferred to the escapement can be reduced in proportion with this gain.

The proportionality supposes that the output of the escapement remains constant. It is possible, by simulation for example, to calculate the torque necessary at the escapement should it not be desirable to make a constant approximation.

The torque transferred to the escapement can thus be reduced by 30%.

By keeping the same barrels, the reduction ratio of the finishing going train will be increased by 30%. The barrel will thus rotate 30% less quickly and it will thus be seen that the power reserve will increase by 30%.

Of course, the increase in the reduction ratio is effected upstream of the deviation of the hand part to ensure that the hands continue to rotate at the same speed.

By keeping the same going trains, the torque of the barrels can also be decreased by 30% whilst maintaining the dimensions thereof in this example. To decrease the torque, the thickness of the spring is reduced, thus with the same size of barrel the number of development turns thereof is increased.

By decreasing the torque from 2.65 Nmm to 1.876 Nmm, a leaf having a thickness of 0.0685 mm instead of 0.082 mm (for a height of 0.74 mm and a length of 370 mm) is obtained. By keeping the same ratio (core radius to thickness), the number of development turns is increased from 9.6 turns to 12.5 turns per barrel, i.e., a gain in the number of turns of 30% and a gain in the power reserve of 30%.

Another possibility for using this energy gain is the reduction in the size of the movement and in particular that of the barrel(s), whilst keeping the same power reserve.

In the same manner as described above, the torque at the escapement can be reduced by 30% in accordance with this example. However, in this case, the torque of the barrel(s) is reduced.

The torque of the barrels is thus reduced by 30% (whilst keeping the same number of winding turns). The simplest way to reduce the torque of the barrel spring by 30% is to reduce the height of the spring by 30% (in fact, the torque provided is proportional to the height of the spring). Of course, a new spring can be completely re-dimensioned.

Decreasing the height of the leaf of the spring by 30% does not directly result in a decrease in the height of the barrel by 30%.

Therefore, a gain in size is achieved which is not proportional to the gain in energy.

For the reduction in torque, the reduction in height of the spring has been adapted. Equally, other dimensions could well be adapted so as to better optimise the gain in size.

Another possibility is to increase the inertia of the balance to keep the same energy loss per oscillation. The precision of the watch is, in fact, linked to the inertia of the balance, in particular its resistance to external disturbances.

Of course, the above list of possible adaptations is not intended to be exhaustive, in particular a mixed solution of all or part of the described solutions can very well be achieved.

For the different calculations made, the inventors have assumed a constant output of the going trains and of the escapement. This is a first approximation quite close to reality. Of course, calculations can be made taking into account the evolution of the outputs of different parts of the watch based on the different changes made (increase in reduction ratio, in torque or in dimensions of the barrels).

The fact that the energy gain of the movement between its operation in atmospheric pressure and its operation in predetermined reduced operating pressure is known allows the adaptation of the movement to be greatly simplified for its operation under reduced pressure.

This method for adapting a gauge provided for operation in atmospheric pressure so as to operate at reduced pressure can also be used, as baseline information, for redesigning a new gauge or movement intended to operate under reduced pressure.

By way of example, by taking the results measured on a traditional factory movement, an average quality factor is increased from 300 at atmospheric pressure to a quality factor of 450 at reduced pressure. The quality factor is calculated using the formula:

$$QF = \frac{4 \times \pi^3 \times f^2 \times I_{bal} \times \theta^2}{\Delta E}$$

and must remain constant; hence it can be shown that if for this traditional movement: Ibal is 6.3 mgcm2; f=4 Hz; then for an amplitude of 290° and a quality factor of 300, we have DeltaE=106 nanojoules, and for an amplitude of 290° and a quality factor of 450, we have DeltaE=71 nanojoules.

The balance thus requires 30% less energy for operating at the same amplitude.

This energy gain can be used to increase the power reserve by increasing the reduction ratio between the barrel(s) and the escapement.

Modification approach:

Necessary torque at the escapement before/after:

DeltaE=(output of escapement)×(torque of escapement)/(number of escapement teeth)

Since the number of teeth of the escapement wheel is 20 in this example, the torque at the escapement will decrease from about 900 microN to 600 microN (presuming that the output of the escapement remains constant at 38%). The necessary torques at the escapement can also be found by digital simulation so as to take into account the output variation.

It is thus necessary to reduce the torque at the escapement by 30%. This torque is reduced by increasing the reduction ratio between the barrels and the escapement wheel by 30%.

The reduction ratio of this traditional movement is 2135. It thus needs to be increased to 2775. The reduction ratio can be increased on one of the going trains such as, for example, between the barrel and the centre wheel (by increasing from a ratio of 100/19 traditionally to 130/19 in the adaptation).

It should be verified that the modification of the going train does not disturb the speed of the hands or otherwise, in that case, the going train will also have to be modified between the finishing going train and the hands.

Advantage:

This adaptation has several advantages:

First of all, it allows the power reserve to be increased by 30% (since the barrels rotate 30% less quickly) changing only the number of teeth of a going train.

The modifications are minor (only two new components: a pinion and a wheel).

This process can be used to rapidly obtain a movement adapted for operation under vacuum without there being a need to completely redesign a movement.

Another process of reducing the torque at the escapement by 30% consists of reducing the torque provided by the barrels by 30%.

Since the torque of the barrels is directly proportional to the height of the barrel spring, a simple way of decreasing the torque is to reduce the height of the spring by 30% and thus to reduce the height of the barrel by 30%.

Thus, if the movement in question has a barrel spring height of 1.5 mm, the spring height can be reduced to 1.15 mm, thus gaining 0.35 mm on the height of the barrel.

In order for this adaptation to be beneficial, it is necessary for the height of the movement to be reduced and thus the height of the movement to be limited by the height of the barrels. From this point of view, it causes more changes than in the preceding adaptation (manufacture of a new barrel, spring, plate and bar . . . ) and it must thus be the case that the gain in the adaptation is more important than a major redesign of the movement. This application is thus, for example, more applicable in the case of a watch with a "big" barrel, in a large complication for example.

The advantages of an adaptation in accordance with the invention over a major redesign are that the gain in vacuum can vary substantially if the oscillator of the movement or the flange of this oscillator (balance-cock and plate) are modified. If a major redesign of the movement is made, it is thus difficult to predict the definitive energy gain (quality factor under vacuum) and thus to dimension the watch (it may be necessary to re-dimension the movement after the first prototype).

With an adaptation of the movement requiring only very few modifications, if any at all, the movement including the oscillator and its flange (for example via an increase in the reduction ratio), the energy gain between the original movement and the adapted movement remains stable and allows the adaptations to be correctly dimensioned from the outset.

A second advantage is, of course, the gain in time. It is much simpler to modify the number of teeth of a wheel and of a pinion in order to increase the reduction ratio than to redesign a complete movement.

The invention claimed is:

1. A method for adapting a timepiece movement provided to operate in ambient atmospheric pressure so as to operate in a low-pressure atmosphere, a timepiece movement comprising a barrel, a regulating member comprised of balance and a balance-spring, an escapement maintaining oscillations of the balance-spring, and a finishing going train transmitting the drive force of the barrel to the escapement, the movement having a size, the method comprising the following steps:

1) measuring a loss of energy for each free oscillation of the balance at atmospheric pressure,
2) measuring the loss of energy for each free oscillation of the balance at a given low pressure corresponding to a working pressure intended for a modified movement,
3) using i) the measured loss of energy at atmospheric pressure and ii) the measured loss of energy at the given low pressure, determining a percentage of energy gain of the balance between respective i) measurements of the measured loss of energy at atmospheric pressure and ii) measurements of the measured loss of energy at the given low pressure, and
4) reducing a torque delivered to the escapement by a value corresponding to the determined percentage of energy gain, the torque delivered to the escapement being reduced by increasing a reduction ratio of the going train by the determined percentage of energy gain.

2. The as claimed in claim 1, further comprising using the determined percentage of energy gain to modify the barrel so as to reduce the size of the movement.

3. The as claimed in claim 1, further comprising using the determined percentage of energy gain to modify the inertia of the balance so as to increase precision of the movement.

4. The method as claimed in claim 1, wherein the working pressure is between 5 mbar and 0.1 mbar.

5. A method for adapting a timepiece movement provided to operate in ambient atmospheric pressure so as to operate in a low-pressure atmosphere, a timepiece movement comprising a barrel, a regulating member comprised of balance and a balance-spring, an escapement maintaining oscillations of the balance-spring, and a finishing going train transmitting the drive force of the barrel to the escapement, the movement having a size, the method comprising the following steps:

1) measuring a loss of energy for each free oscillation of the balance at atmospheric pressure;
2) measuring the loss of energy for each free oscillation of the balance at a given low pressure corresponding to a working pressure intended for a modified movement; and
3) using i) the measured loss of energy at atmospheric pressure and ii) the measured loss of energy at the given low pressure, determining a percentage of energy gain of the balance between respective i) measurements of the measured loss of energy at atmospheric pressure and ii) measurements of the measured loss of energy at the given low pressure; and
4) reducing a torque delivered to the escapement by a value corresponding to percentage of energy gain, the torque delivered to the escapement being reduced by decreasing a torque to the barrel by the determined percentage of energy gain.

6. The method as claimed in claim 5, further comprising using the determined percentage of energy gain to modify the barrel so as to reduce the size of the movement.

7. The method as claimed in claim 5, further comprising using the determined percentage of energy gain to modify the inertia of the balance so as to increase precision of the movement.

8. The method as claimed in claim 5, wherein the working pressure is comprised between 5 mbar and 0.1 mbar.

* * * * *